US009867467B2

(12) United States Patent
Thorwesten

(10) Patent No.: US 9,867,467 B2
(45) Date of Patent: Jan. 16, 2018

(54) SEATING FURNITURE WITH PIVOTABLE FUNCTIONAL PART

(71) Applicant: Ferdinand Lusch GmbH & Co. KG, Bielefeld (DE)

(72) Inventor: Andreas Thorwesten, Hoevelhof (DE)

(73) Assignee: Ferdinand Lusch GmbH & Co. KG, Bielefeld (DE)

( * ) Notice: Subject to any disclaimer, the term of this patent is extended or adjusted under 35 U.S.C. 154(b) by 19 days.

(21) Appl. No.: 14/961,315

(22) Filed: Dec. 7, 2015

(65) Prior Publication Data

US 2016/0157614 A1 Jun. 9, 2016

(30) Foreign Application Priority Data

Dec. 8, 2014 (DE) ..... 10 2014 118 102

(51) Int. Cl.

| | |
|---|---|
| ***A47C 1/10*** | (2006.01) |
| ***A47C 7/00*** | (2006.01) |
| ***A47C 7/38*** | (2006.01) |
| ***A47C 7/40*** | (2006.01) |
| ***A47C 7/50*** | (2006.01) |
| ***A47C 7/54*** | (2006.01) |

(52) U.S. Cl.

CPC ..... *A47C 7/00* (2013.01); *A47C 7/38* (2013.01); *A47C 7/402* (2013.01); *A47C 7/506* (2013.01); *A47C 7/543* (2013.01)

(58) Field of Classification Search

CPC .... A47C 1/024; A61G 5/1067; B60N 2/2218; B60N 2/2236

USPC ... 297/363, 364, 365, 366, 367 R, 369, 356, 297/410, 362, 354.1, 353; 108/9

See application file for complete search history.

(56) References Cited

U.S. PATENT DOCUMENTS

| | | | | |
|---|---|---|---|---|
| 192,898 A * | 7/1877 | Clough | B60N 2/34 | 297/364 |
| 1,654,726 A * | 1/1928 | Graham | B60N 2/34 | 297/357 |
| 2,278,890 A * | 4/1942 | May | A61G 15/02 | 188/67 |
| 2,590,718 A * | 3/1952 | Lundquist | A47C 1/027 | 297/358 |

(Continued)

FOREIGN PATENT DOCUMENTS

| | | |
|---|---|---|
| DE | 10236158 A1 | 2/2004 |
| DE | 202013004428 U1 | 8/2013 |

(Continued)

*Primary Examiner* — Jose V Chen
(74) *Attorney, Agent, or Firm* — The Webb Law Firm

(57) ABSTRACT

Seating furniture including a base body and a functional part which can pivot with respect to the base body, at least one pivot fitting for adjusting the functional part relative to the base body, and a separate lift setting mechanism. The functional part is connected to the base body by an adjusting lever. The pivot lever and the adjusting lever can be pivoted about a pivot axis with respect to one another. The adjusting lever can be moved with respect to the base body out of a lower position into an upper position and back. The steering lever can pivot with respect to the pivot lever and with respect to the control lever. The control lever can pivot with respect to the base body and/or to the adjusting lever and the control lever is connected to the adjusting lever.

17 Claims, 12 Drawing Sheets

(56) References Cited

U.S. PATENT DOCUMENTS

| | | | | | |
|---|---|---|---|---|---|
| 3,226,158 | A * | 12/1965 | Strien | B60N 2/233 | 248/354.3 |
| 3,710,735 | A * | 1/1973 | Litvinoff | A47B 9/00 | 108/146 |
| 3,727,978 | A * | 4/1973 | Barriere | B60N 2/2352 | 297/369 |
| 4,181,357 | A * | 1/1980 | Swenson | B60N 2/143 | 297/353 |
| 5,695,239 | A * | 12/1997 | Johnson | A47C 7/506 | 297/423.25 |
| 6,789,848 | B2 | 9/2004 | Rauschenberger et al. | | |
| 6,948,772 | B1 * | 9/2005 | Robinson | B60N 2/23 | 297/362.12 |
| 8,438,676 | B2 * | 5/2013 | Murphy | A47C 3/16 | 5/28 |
| 9,055,822 | B2 * | 6/2015 | Baldassarra | A47C 17/22 | |
| 2006/0103218 | A1 * | 5/2006 | De Vroe | A47C 1/035 | 297/423.26 |

FOREIGN PATENT DOCUMENTS

| | | | |
|---|---|---|---|
| DE | 102012006235 | A1 | 9/2013 |
| DE | 202014000212 | U1 | 2/2014 |
| EP | 2638827 | A1 | 9/2013 |

* cited by examiner

SEATING FURNITURE WITH PIVOTABLE FUNCTIONAL PART

CROSS-REFERENCE TO RELATED APPLICATION

This application claims priority to German Patent Application No. 10 2014 118 102.6 filed Dec. 8, 2014, the disclosure of which is hereby incorporated in its entirety by reference.

BACKGROUND OF THE INVENTION

Field of the Invention

The invention relates to seating furniture, preferably an armchair or sofa, having a base body, preferably a backrest, a seat or a frame and a functional part, preferably a head part, a foot part or an armrest, which can pivot fitting with respect to the base body, at least one pivot fitting for adjusting the functional part relative to the base body and a preferably separate lift setting mechanism for locking the functional part with respect to the base body, the lift setting mechanism having a guide means and a lug which is displaceable with respect to the guide means, the lift setting mechanism being movable out of an adjustment position which blocks, in a positive and/or clamping manner, the movement of the functional part relative to the base body into several positions in a direction of load into a reset position which releases the movement of the functional part relative to the base body from at least one position in the direction of load and the functional part being supported by a pivot lever.

The invention also relates to seating furniture, preferably an armchair or sofa, having a base body, preferably a backrest, a seat or a frame and a functional part, preferably a head part, a foot part or an armrest, which can pivot fitting with respect to the base body, at least one pivot fitting for adjusting the functional part relative to the base body and a locking joint for locking the functional part with respect to the base body in a locking position of the locking joint, the functional part being supported by a pivot lever and being connected to the base body by an adjusting lever, the pivot lever and the adjusting lever being interconnected by the locking joint which forms a pivot axis and the locking joint having a toothed ring and a locking mechanism which engages in the toothed ring in the locking position.

Description of Related Art

Various configurations of seating furniture, for example in the form of sofas or armchairs, are known which have pivotable functional parts with respect to a base body and allow the user to adopt a comfortable sitting and/or reclining position. Possible functional parts are in particular head parts which are also known as head supports, foot parts or armrests. Considered here as basic bodies are all bodies of the seating furniture, relative to which the functional part is adjusted. In this respect, possible basic bodies are particularly those which are themselves not adjusted, although this is not obligatory. The base body can be, for example a backrest, a seat or a frame in which the seat and/or the backrest can be accommodated. However, instead of a frame, a chassis is also possible which together with attachment parts, for example in the form of side parts, can form a frame.

In this respect, the person using the seating furniture can rest his head comfortably against the head part, he can put his feet or legs comfortably on the foot part and can rest his arms comfortably on the armrests. A possible motor adjustment of the head part with respect to the backrest further enhances the user's comfort. Furthermore, the functional part can be fixed in any position.

To adjust the functional part, the seating furniture has so-called pivot fitting which allow a specific adjustment of the functional part relative to the base body. The pivot fitting have at least one pivot lever which at least partly supports the functional part.

To ensure an appropriate adjustability and at the same time a lockability of the functional part in the desired position or in different positions, in some cases so-called lift setting mechanisms are used. Lift setting mechanisms comprise a guide means, for example in the form of a housing, and a lug which can be moved and extended with respect to the guide means. In this respect, the lug and guide means are preferably interconnected in a substantially linearly guided manner. Furthermore, the lug supports a spring-loaded catch element which, as a result of the spring force when the lug is extended, engages or can engage in seats provided for this purpose along the guide means. In this respect, the seats and the catch element are coordinated with each other such that after the lug has engaged in a seat, it cannot be moved again in the opposite direction along the guide means or cannot be reinserted into the guide means, optionally in the form of a housing. This is prevented by the positive engagement of the catch element in the corresponding seat. However, the lug can be easily further moved or extended out of the same position. To be able to bring the lug back into the starting position, it must firstly be moved or extended into an end position. In so doing, the catch element is blocked so that when the lug is pushed back, for example into the housing, the catch element cannot engage in the seats. However, when the lug is again extended relative to the guide means or is extended out of the housing, the catch element is reactivated and consequently re-engages, at least potentially, successively in the seats.

Due to the previously described blocking of a movement of the lug and the releasing, as required, of this movement, the lift setting mechanism also blocks the movement of the functional part, more specifically preferably in a direction of load. This occurs when the functional part is loaded as intended by the user. Due to the coupling of functional part and base body to the pivot fitting and the lift setting mechanism, the movement of the lug relative to the guide means of the lift setting mechanism is accompanied by an adjustment of the functional part relative to the base body and vice versa.

For other seating furniture of the mentioned type, a locking joint for locking the functional part relative to the base body in a locking position of the locking joint is provided instead of a lift setting mechanism. In this respect, the locking joint connects the pivot lever which supports the functional part, to the adjusting lever by which the pivot lever is connected to the base body. Furthermore, the locking joint forms a pivot axis about which the pivot lever and thereby the functional part can be pivoted about the adjusting lever, more specifically in any case in one direction (adjustment direction). However, in the other direction in which the pivot lever is loaded during intended operation (direction of load), the pivot pivoting movement of the pivot lever is at least partly obstructed. For this purpose, the locking joint has a toothed ring and a locking mechanism which can be configured, for example as a pawl or it can have a row of teeth corresponding to the toothed ring. In a locking position of the locking joint, the locking mechanism engages in the toothed ring and prevents the toothed ring from being able to rotate with respect to the locking mechanism in the aforementioned direction. In this way, the pivot lever can be held in different positions, depending on the point at which the locking mechanism engages in the toothed ring.

In this respect, the locking mechanism can be associated with the adjusting lever and the toothed ring can be associated with the pivot lever or vice versa. If the locking mechanism and the toothed ring are rigidly connected to the corresponding lever, the engagement between locking mechanism and toothed ring prevents the pivot lever from being pivoted with respect to the adjusting lever in the direction of load. It is possible for the pivot lever to pivot about the adjusting lever in the opposite direction, which is achieved by a corresponding bevel of the teeth of the toothed ring and/or by an appropriate configuration of the locking mechanism. Thus, while pivoting in one direction, the toothed ring slides on the locking mechanism, whereas this is not the case in the opposite direction, more specifically in different positions of the pivot lever. In order to move the pivot lever back into the starting position, it must firstly be pivoted into an end position. Only then is it possible for the pivot lever to pivot back into the starting position by an appropriate mechanism.

A disadvantage of previous seating furniture is the installation space required for the pivot fitting and/or the complexity of the pivot fitting. For this reason, corresponding seating furniture has a corresponding size and/or complexity, which is obstructive, less attractive and more cost-intensive.

SUMMARY OF THE INVENTION

Thus, the object of the present invention is to configure and develop seating furniture of the type which has been mentioned at the outset and previously described in detail such that the seating furniture can be of a smaller and/or simpler construction, without appreciably limiting the functionality.

This object is achieved with seating furniture according to the present disclosure in that the functional part is connected to the base body by an adjusting lever, in that the pivot lever and the adjusting lever can be pivoted relative to one another about a pivot axis, in that the adjusting lever can be moved relative to the base body from a lower position into an upper position and back, in that the pivot lever is connected to the base body by a lever connection comprising a steering lever and a control lever, in that the steering lever can pivot pivot relative to the pivot lever and relative to the control lever, in that the control lever can pivot pivot relative to the base body and/or to the adjusting lever and in that the control lever is connected to the adjusting lever such that when the adjusting lever is moved from the lower position into the upper position and back, the control lever is pivoted with respect to the base body and/or the adjusting lever and thus causes via the steering lever a pivoting pivoting movement of the pivot lever relative to the adjusting lever.

This object is achieved with seating furniture according to the present disclosure in that the adjusting lever can be moved from a lower position into an upper position and back with respect to the base body, in that the pivot lever is connected to the base body by a lever connection comprising a steering lever and a control lever, in that the steering lever can pivot relative to the pivot lever and relative to the control lever, in that the control lever can pivot relative to the base body and/or to the adjusting lever and in that the control lever is connected to the adjusting lever such that when the adjusting lever is moved from the lower position into the upper position and back, the control lever is pivoted with respect to the base body and/or the adjusting lever and thus causes via the steering lever a pivoting pivoting movement of the pivot lever relative to the adjusting lever.

It is thus provided that the functional part is held by a pivot lever which is supported on the base body to adjust the functional part by an adjusting lever, the pivot lever being pivotable with respect to the adjusting lever and the adjusting lever can be adjusted with respect to the base body. Furthermore, the pivot lever is connected to the base body by a further lever connection, said lever connection comprising at least one steering lever and one control lever. The steering lever is mounted such that it can pivot relative to the pivot lever and relative to the control lever. In addition, the control lever can pivot relative to the base body and/or to the adjusting lever and is connected to the adjusting lever so that the adjusting lever pivots the control lever when the adjusting lever is adjusted in height, in particular when it is extended or retracted relative to the base body.

For this purpose, the control lever can be fixed with respect to the base body by the end remote from the steering lever such that this end cannot be moved by the adjusting lever in the same way as the region of the pivot lever connected to the adjusting lever. However, in this respect, the control lever does not have to be fixed in a completely stationary manner with respect to the base body.

The fact that the pivot lever is connected to the base body by a lever connection or is supported on the base body by an adjusting lever means that there does not have to be a direct connection between the lever connection or the adjusting lever and the base body.

Further components can be provided between the lever connection or the adjusting lever and the base body. In the present case, this also applies to further connections which are described analogously.

In particular, if the functional part is a head part and if the base body is a backrest, the connection between the control lever and the adjusting lever can be configured such that the control lever is pivoted upwards at at least one end when the adjusting lever is moved from the lower position into the upper position. When the adjusting lever is moved from the upper position into the lower position, the same end of the control lever can be pivoted downwards. This end can be associated with the steering lever and can thus move this lever upwards or downwards, depending on the adjustment of the adjusting lever, as a result of which the pivot lever is moved into the swiveled-up upper position or into the swiveled-back lower position. The free movability of the end of the control lever remote from the steering lever can be blocked by a connection of this end to the base body in any case relative to the opposite end of the control lever.

Thus, when the functional part is moved via the height adjustment of the adjusting lever, the functional part is moved upwards or downwards and is also pivoted forwards and backwards via the simultaneous pivoting movement of the control lever. The movement of the functional part upwards and forwards to the swiveled-up position results in a stretching of the cushion portion which is bent to a greater extent in the swiveled-back position of the functional part. This allows the functional part to move without folds forming in the cushion. If the base body and functional part are padded, a pure pivoting movement of the functional part out of an angled position relative to the base body into a position which is oriented substantially parallel to the base body would result in the formation of folds in the cushioning material which is surplus in this position. By lowering the functional part when it is pivoted into the swiveled-back position, cushioning material is provided for bending the cushion backwards, so that in this region, the cushion does not have to be extended or stretched.

If the functional part is a foot part and the base body is a seat, the pivot lever is pivoted upwards, while the control lever and the adjusting lever are moved forwards and vice versa. The pivot fitting is then preferably installed in the longitudinal direction or approximately horizontally and not, for example in a vertical direction as for pivoting a head part relative to a backrest. The functional part in the form of a foot part is ultimately preferably moved backwards and forwards by the adjusting lever and is also pivoted upwards and downwards by the simultaneous pivoting of the control lever. Moving the functional part upwards and forwards into the swiveled-up position again leads to stretching of the cushion portion which is bent to a greater extent in the swiveled-back position of the functional part. This makes it possible for the functional part to move without folds forming in the cushion.

Moreover, the mechanism for adjusting the functional part manages with relatively few components. Therefore, the corresponding mechanism can be assembled in a fast and cost-effective manner.

To reduce components, it is preferred if the steering lever is connected directly to the pivot lever and to the control lever. This can be performed in each case by a pivot pivot connection so that the steering lever can be respectively pivoted about a pivot axis with the pivot lever and the control lever. However, if required, further components can in principle be integrated into the pivot fitting.

In a first preferred embodiment of the seating furniture, the lift setting mechanism has a catch element which cooperates with at least one seat, in particular with a plurality of seats. The plurality of seats is then selected such that the catch element can engage in a respective seat in different positions of the lug with respect to the guide means of the lift setting mechanism. In this respect, the catch element is in particular spring-loaded to assist engagement in the at least one seat. By engaging in a seat, the catch element forms a locking connection which positively blocks the movement of the lug relative to the guide means or of the functional part relative to the base body in one direction, particularly in the direction of load. When there is a plurality of seats, the position of the lug of the lift setting mechanism can be locked in different positions, in any case in a direction of the movement of the lug with respect to the guide means. Furthermore, from a constructional point of view it is preferred if the at least one seat is provided in the guide means, particularly in the form of a housing, and if the at least one catch element is provided on the lug.

Furthermore, the catch element can be deactivatable so that the lug can be moved with respect to the guide means without blocking it, more specifically in particular so that the functional part can be moved with respect to the base body in the direction of load. Deactivation is produced by moving the lug with respect to the guide means into an end position.

The catch element can then be held, for example in a retracted position in which the catch element cannot engage with the at least one seat. Furthermore, by moving the lug with respect to the guide means in another end position, the catch element can be reactivated so that the catch element can again engage with the at least one seat. Thus, in the deactivated position of the catch element, the lug can be moved back in a direction in which it is prevented from moving in the activated position.

With regard to functionality, it is particularly preferred if the lift setting mechanism has at least one clamping element which is displaceable relative to the lug between a clamping position and a movement position. In the clamping position, the clamping element can be received in a clamping manner in a clamping gap between the lug and the guide means, particularly in the form of a housing, thereby preventing the lug from moving in one direction relative to the guide means. This direction is preferably the direction in which the lug is loaded when the functional part is subjected to an intended load. This load can be caused by the user's head resting on the head part, by the legs resting on the foot part or by the arms resting on the armrests. Due to the clamping element being clamped in the clamping gap, the functional part cannot be moved back in the direction of a starting position with partial deflection. In the movement position, the clamping element is not clamped in the clamping gap. The lug can thus be moved in one direction with respect to the guide means. However, this is only partly possible in the opposite direction. After a very short movement path, the clamping element passes so far into the clamping gap that the clamping element is held in a clamping manner in the clamping gap and blocks a continued movement of the lug in this direction. Due to the clamping action, a quieter and more precise movement of the functional part with respect to the base body can ultimately be achieved.

A constructively simple and simultaneously functional embodiment of the lift setting mechanism is achieved when the clamping gap tapers in one direction and/or when the clamping element is clamped in the clamping position between a tapering end of the lug and the guide means. More complex embodiments of the lift setting mechanism which would be liable to malfunction are therefore not required. Furthermore, the clamping gap narrows opposite the direction in which the clamping of the lug is produced. In addition, it is preferred if the clamping forces are great enough for the lug to be reliably clamped in the appropriate direction, more specifically also during the force effects of an unintended use.

To simplify and ensure the displaceability of the clamping element with respect to the lug out of the movement position into the clamping position and back, a clamping slide can be provided which has the at least one clamping element and is also provided to be displaceable with respect to the lug. The displaceable coupling of lug and clamping slide can be simply ensured by a slot or elongated hole provided in the lug, the clamping slide engaging in the slot.

To hold the clamping element securely in the movement position and accordingly to allow free movement without blocking, a releasable connection is provided between the lug and the clamping element and/or the clamping slide. The releasable connection can be closed in a clamping and/or locking manner in a connection position by moving the lug with respect to the guide means without a separate operation. For the sake of simplicity and reliability, this is carried out by in particular by a stop of the clamping element and/or of the clamping slide on an end stop.

In this respect, the clamping element and/or the clamping slide can rest at least in portions in a frictionally locking manner on the guide means. When the lug is moved successively in opposite directions with respect to the guide means, during a change of direction of the lug the clamping element and/or the clamping slide initially remains in a position which results in a relative movement of clamping element and lug. Consequently, the at least one clamping element is clamped in the clamping gap or is moved out of a clamped position into a non-clamping position.

In a particularly preferred embodiment of the lift setting mechanism, the lug is substantially continuously movable and/or clampable along the guide means. Since the clamping blocking action of the lift setting mechanism does not require any seats which must have between each other a respective considerable minimum distance, in principle the clamping element can be clamped along the entire movement path of the lift setting mechanism in the clamping gap between lug and guide means.

In a first preferred item of seating furniture comprising a locking joint, the locking mechanism is spring-loaded in the direction of the toothed ring. In this way, it is ensured in the locking position that the locking mechanism engages in the toothed ring, particularly with different orientations of toothed ring to locking mechanism or with different angular positions of the pivot lever, to prevent the toothed ring from rotating into the reset position or into the direction of load from the respective position.

Alternatively or additionally, it is possible for the toothed ring and the locking mechanism to be disengaged in a pivot position to be able to pivot the pivot lever relative to the adjusting lever back into the starting position. It is particularly simple and reliable when, for this purpose, the pivot lever must firstly be brought into an end position to thereby transfer the locking joint out of the locking position into a reset position. In this respect, the locking joint preferably arrives by force in the reset position without further intervention by the user. In the reset position, the locking mechanism is separate from the toothed ring, more specifically in particular over the entire movement path of the pivot lever until said lever has reached the starting position. The locking joint then arrives back in the locking position, also in a preferably forcible manner. The pivot lever can then be gradually moved again to adjust a comfortable position for the user, without having to fear an inadvertent return of the pivot lever in the respective positions.

Alternatively or additionally, the handling of the pivot fitting can be simplified in that the pivot lever and the adjusting lever are held non-positively against one another. This frictional connection can be overcome by adequate forces on the pivot lever in the direction of load. The frictional connection should be adjusted such that the pivot fitting can be moved into the adjustment direction by the sliding movement of toothed ring and locking mechanism. The frictional connection should also be great enough for a pivoting of the pivot lever into the reset direction to be prevented by the engagement of toothed ring and locking mechanism. Only when significantly greater forces are applied does the frictional connection allow the static friction to be overcome and the pivot lever to be moved into the reset direction. Thus, on the one hand the pivot lever is prevented from being accidentally reset and on the other hand the locking joint is prevented from being damaged by an excessive force effect. Corresponding locking joints can also be called locking/clamping joints based on the previously described function. To allow the pivot lever to be reset in spite of the engagement between toothed ring and locking mechanism, it is appropriate for the toothed ring and/or the locking mechanism to be held rotatably with respect to the pivot lever and/or to the adjusting lever such that in the locking position, the pivot lever can be pivoted in one direction with respect to the adjusting lever.

To be able to adjust the clamping force between the pivot lever and the adjusting lever, which force acts on the locking joint and prevents the pivot lever from being moved too easily with respect to the adjusting lever, the locking joint can have a clamping means. The clamping means can be configured as a screw connection, for example comprising a screw which is provided concentrically to the rotational axis of the locking joint. The pivot lever, the adjusting lever and, if required, further components can then be easily clamped between the screw head and a nut, screwed onto the screw, with the desired intensity.

In a further preferred embodiment of the seating furniture which can have a lift actuator and/or a locking joint respectively of the previously described type to lock the functional part, the control lever is connected by one end to the base body, by another end to the steering lever and is connected between both ends to the adjusting lever. Then, with a short construction length, the control lever can produce a reliable and extensive adjustment of the functional part. The control lever can be swiveled upwards or downwards due to the connection to the adjusting lever at the end associated with the steering lever. Consequently, the steering lever can also be moved relative to the backrest to thus pivot the pivot lever upwards or downwards or backward or forwards.

Furthermore, it is simple and reliable in terms of construction for the control lever and the adjusting lever to be interconnected by a pivot connection, particularly by a pivot joint. The adjusting lever and the control lever can then form a common pivot axis or rotational axis.

Alternatively or additionally, the lever connection comprising the steering lever and the control lever can engage on the pivot lever by a pivot connection, in particular by a pivot joint to simplify the construction and, for the sake of simplicity, the pivot connection can define a pivot axis or a rotational axis between the pivot lever and the steering lever. In this connection, it is particularly preferred if the pivot connection between the pivot lever and the steering lever engages on the pivot lever between the end of the pivot lever associated with the free end of the functional part on the one hand and between a pivot connection between the pivot lever and the adjusting lever on the other. Consequently, the connection between the pivot lever and the lever connection can define a pivot axis which is arranged between the end of the pivot lever, associated to the free and of the functional part and the pivot axis of the pivot axis and the pivot lever. This measure allows a suitable adjustment of the functional part forwards from behind and back or upwards and back (depending on the installation position and functional part). In this respect, to reduce installation space, it is advantageous if the lever connection engages on the pivot lever close to the pivot axis between the pivot lever and the adjusting lever. A great distance is not required here for transferring a sufficiently great moment onto the pivot lever.

To ensure a simple movability and a stable mounting of the adjusting lever, the adjusting lever can be held on the base body by a mount and can be extended, preferably telescoped at least partly in a vertical direction with respect to the mount. For this purpose, the mount and/or the adjusting lever can be configured as a rail element. For the purpose of displaceability, the mount and the adjusting lever are preferably configured as a rail system. Furthermore, to reduce frictional forces, at least one rail element can be mounted on rollers.

To simplify the constructive outlay, the control lever can be fixed directly on the mount for the adjusting lever. To be able to compensate for movements when the functional part is adjusted, the control lever can, however, also be fixed on the mount, for example by a compensating lever.

Furthermore, it is preferred if the lug of the lift setting mechanism is connected to a steering lever and if the guide means of the lift setting mechanism is connected to the base body. The lift setting mechanism could also be integrated into the pivot fitting as a lever. However, for functional reasons and for ease of repair, it is preferred if the pivot fitting for adjusting the functional part and the lift setting mechanism for locking the functional part are configured separately. Furthermore, the lug and/or the guide means of the lift setting mechanism can be connected to the functional part and/or to the base body instead of being connected to the pivot fitting.

BRIEF DESCRIPTION OF THE DRAWINGS

In the following, the invention will be described in more detail with reference to drawings which show only one embodiment.

DETAILED DESCRIPTION OF THE INVENTION

Figure 1:
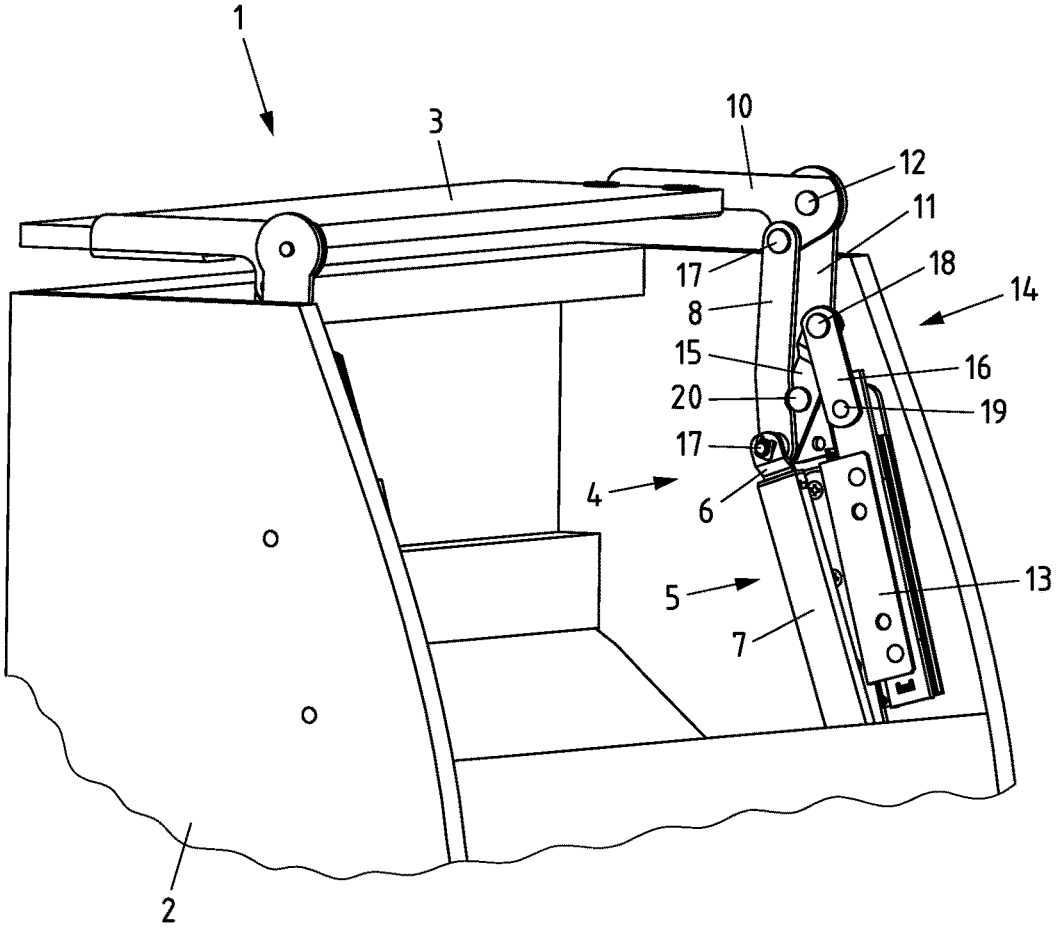
FIG. 1 is a perspective view of a detail of seating furniture according to the invention with a swiveled-back functional part.

FIG. 1 shows the internal construction of an item of seating furniture 1 having a base body 2 in the form of a backrest and an adjustable functional part 3 in the form of a head part, more specifically on the right-hand side of the seating furniture 1 which is in the form of an armchair. The pivot fitting 4, provided on the right-hand side of the seating furniture 1, for adjusting the functional part 3 is also provided in the same way in a mirror-inverted manner on the left-hand side (not shown) of the seating furniture 1.

In addition to the pivot fitting 4, a respective separate lift setting mechanism 5 is provided which is connected to the pivot fitting 4 and prevents the functional part 3 from being inadvertently swiveled back again into the swiveled-back starting position from a partly swiveled-up position due to the user resting his head on the head part. The lift setting mechanism 5 comprises a lug 6 which is guided on a guide means 7 and is displaceable with respect to the guide means 7. In the illustrated and in this respect preferred item of seating furniture 1 the guide means 7 is configured as a housing from which the lug 6 can be extended to move the pivot fitting 4 and the functional part 3 out of the swiveled-back starting position shown in FIG. 1, more specifically in the direction of a swiveled-up position of the functional part 3. In the illustrated and in this respect preferred item of seating furniture 1, the lug 6 of the lift setting mechanism 5 is connected pivotably to a steering lever 8, whereas the guide means 7 of the lift setting mechanism 5 is fixed relative to the base body 2 in the form of the backrest.

Figure 2:
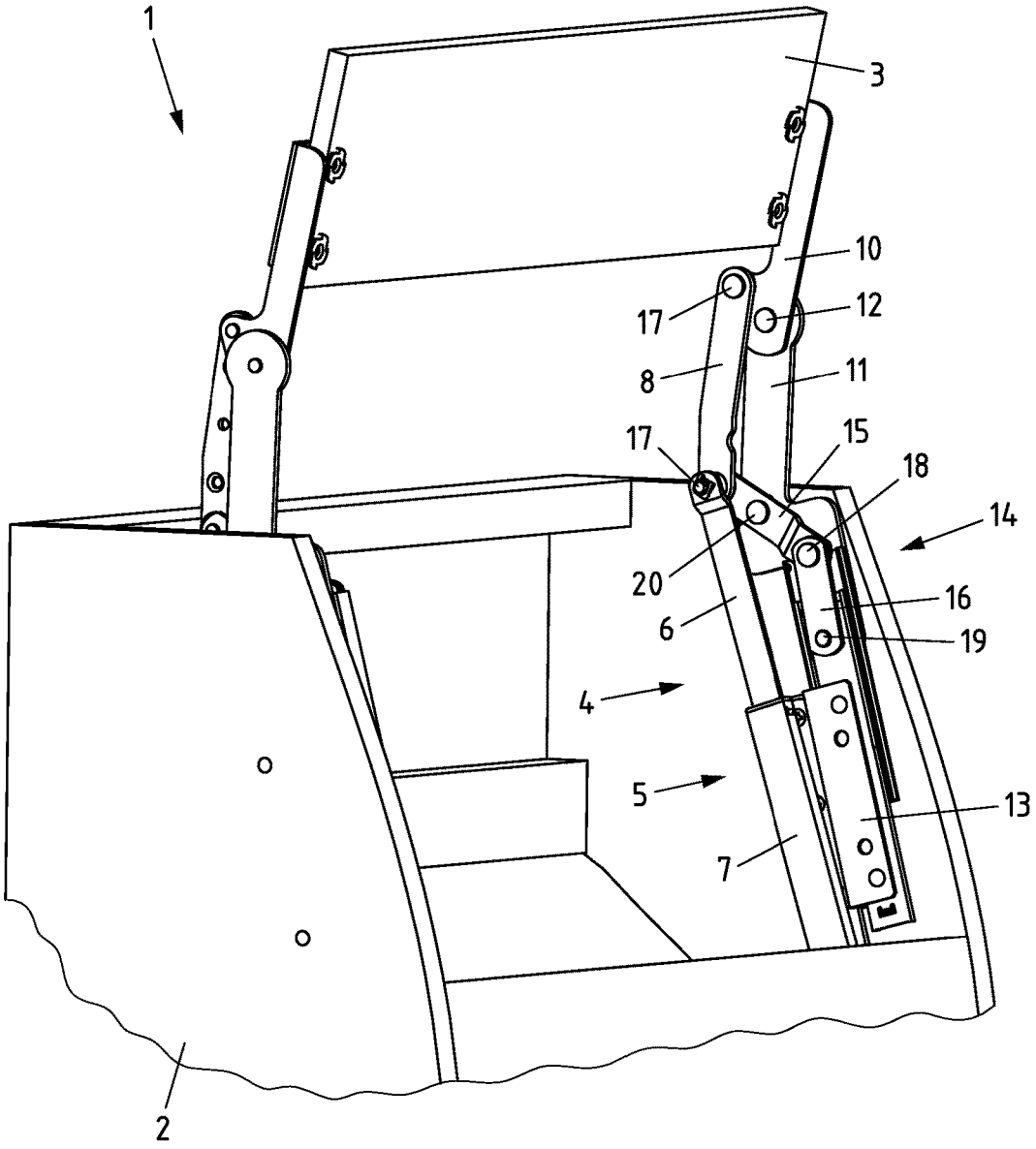
FIG. 2 is a perspective view of the detail from FIG. 1 with a swiveled-up functional part.

The functional part 3 can be moved manually upwards into the swiveled-up position from its swiveled-back position shown in FIG. 1. The swiveled-up position is shown in FIG. 2. In the swiveled-up position of the functional part 3, the functional part 3 has not only been pivoted forwards, but has also been moved upwards. The pivot fitting 4 shown in more detail in FIG. 3 is used for this purpose.

Figure 3:
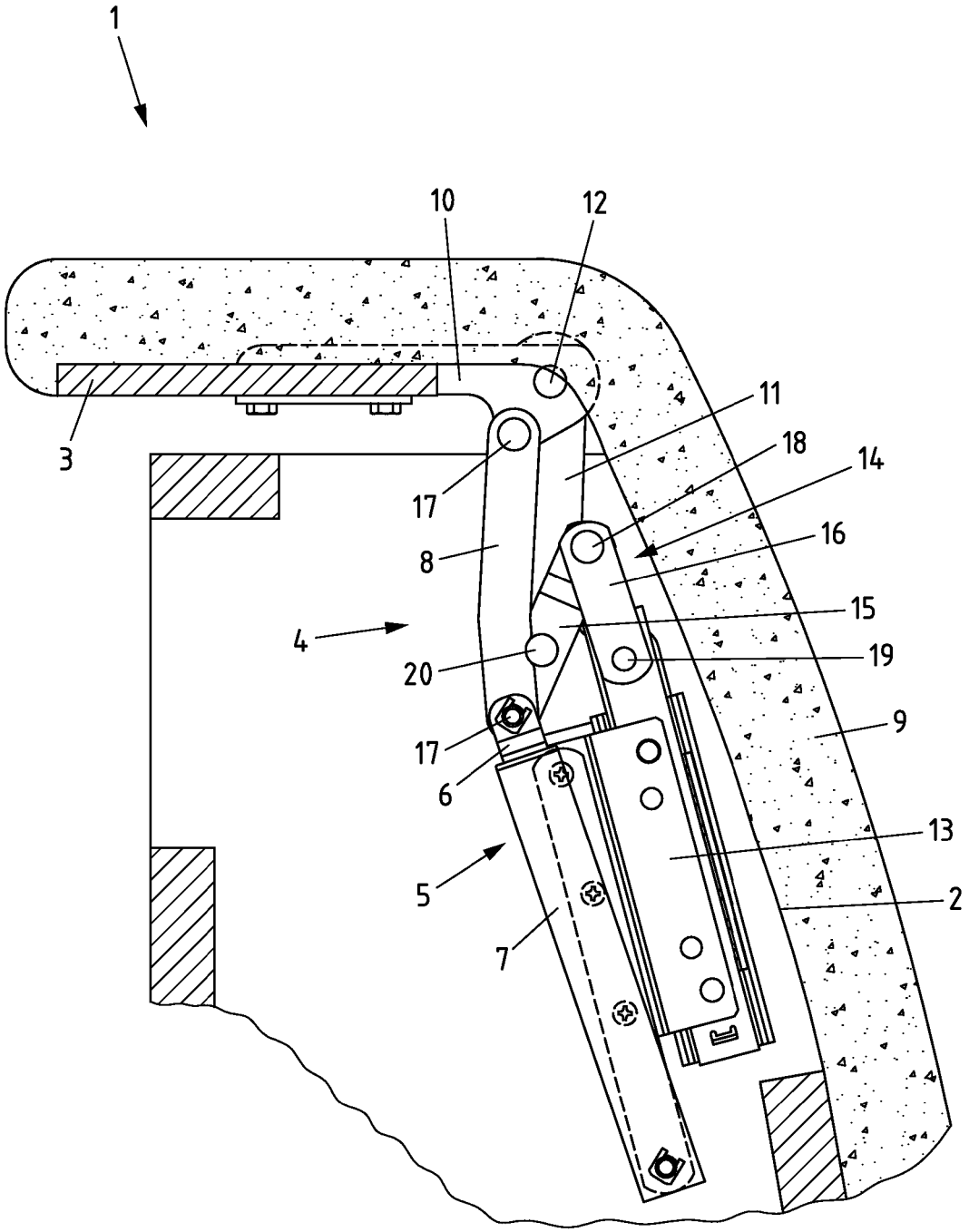
FIG. 3 is a side view of the seating furniture from FIG. 1 with a cushion and a swiveled-back functional part.

FIG. 3 also shows, in addition to the pivot fitting 4, the base body 2 and the functional part 3 in the swiveled-back position together with cushioning 9. In the view according to FIG. 4, the functional part 3 is in the swiveled-up position in the same item of seating furniture 1. The functional part 3 is supported by a pivot lever 10 on the respectively illustrated side of the seating furniture 1. The pivot lever 10 has a free end which, in the illustrated and in this respect preferred item of seating furniture 1 is oriented in the direction of the free end of the functional part 3 or is at least associated therewith. The pivot lever 10 is mounted by its opposite end in a freely rotatable manner on an adjusting lever 11. The pivot connection 12 between the pivot lever 10 and the adjusting lever 11 allows the functional part 3 to swivel in a free, unhindered manner with respect to the adjusting lever 11 over the entire adjustment range of the functional part 3.

The adjusting lever 11 of the illustrated and in this respect preferred item of seating furniture 1 is approximately Z-shaped and is accommodated by the end remote from the pivot lever 10 in a mount 13 or is held on a mount 13. The mount 13 is fixed on the base body 2. In this respect, the lower portion of the adjusting lever 11 and the mount 13 of the illustrated and in this respect preferred item of seating furniture 3 form a rail system which is configured such that the adjusting lever 11 can be extended upwards out of the mount 13 and then retracted again downwards into the mount 13. The functional part 3 can ultimately be moved upwards and downwards with respect to the base body 2 via the displacement of the adjusting lever 11.

The mount 13 is also connected to the guide means 7 of the lift setting mechanism 5, the guide means 7 being linked swivelably to the mount 13. Alternatively, the guide means 7 could also be directly linked to the base body 2, although this connection would possibly be less stable.

A lever connection 14 between the pivot lever 10 and the base body 2 is used to pivot the functional part 3 with respect to the base body 2. This lever connection 14 engages as a pivot joint on the pivot lever 10 adjacently to the pivot connection 12 between the pivot lever 10 and the adjusting lever 11, more specifically when the functional part 3 has been pivoted back, both in the horizontal direction and in the vertical direction at a distance from the pivot joint between the pivot lever 10 and the adjusting lever 11. The specified directions of vertical and horizontal are understood for the seating furniture 1 which has been set down on flat horizontal ground. Thus, the engagement point of the lever connection 14 on the pivot lever 10 is on the one hand offset downwards with respect to the pivot joint of the pivot lever 10 with the adjusting lever 11 and on the other hand is offset backwards with respect to the free end of the pivot lever 10 or of the functional part 3.

The lever connection 14 between the pivot lever 10 and the base body 2 comprises the steering lever 8, a control lever 15 and a compensating lever 16. Further levers or the like would be possible, but should generally be avoided from a construction point of view. In the illustrated and in this respect preferred seating furniture 1, the steering lever 8 is respectively connected to the pivot lever 10 and to the control lever 15 by a pivot connection 17 in the form of a pivot joint.

The steering lever 8 substantially extends on the back of the adjusting lever 11. The steering lever 8 is also swivelably connected to the control lever 15 by a connection 17 in the form of a pivot joint. The same connection 18 is provided at the other end of the control lever 15 to couple the control lever 15 to a compensating lever 16 which, in for its part, is fixed pivotably on the mount 13 of the adjusting lever 11. In principle, it could also be possible to dispense with the compensating lever 16. However, in the present case, the compensating lever 16 allows a relatively convenient adjustment path of the functional part 3 and is fixed to the mount 13 by the pivot connection 19.

The control lever 15 is connected to the adjusting lever 11 between its connections 17, 18 to the compensating lever 16 on the one hand and to the steering lever 8 on the other. In the illustrated and in this respect preferred seating furniture 1, the control lever 15 is connected to the adjusting lever 11 by a pivot connection 20 in the form of a pivot joint. Therefore, when the adjusting lever 11 is moved, the control lever 15 is pivoted and thereby moves the steering lever 8 upwards or downwards, depending on the movement of the adjusting lever 11. As a result, the steering lever 8 pivots the pivot lever 10 together with the functional part 3 forwards and backwards about the pivot connection 12 of the pivot lever 10 to the adjusting lever 11.

The mode of operation of the seating furniture 1 shown in the drawing is as follows:

The swiveled-back position of the functional part 3 according to FIGS. 1 and 3 can be considered as the starting state. The functional part 3 can be pivoted up out of this position, and this results in the lug 6 of the lift setting mechanism 5 being moved out of the guide means 7 of the lift setting mechanism 5, which guide means is configured in the illustrated and in this respect preferred seating furniture 1 in the form of a housing, particularly in the form of a closed housing to protect against soiling.

In this respect, the steering lever 8 is moved upwards, swiveling the pivot lever 10 with respect to the adjusting lever 11 about the common pivot axis between pivot lever 10 and adjusting lever 11 into a relatively upright position. Furthermore, the steering lever 8 entrains upwards the end of the control lever 15, connected to the steering lever 8. This results in the adjusting lever 11 being raised via the connection 20 between the control lever 15 and the adjusting lever 11. The adjusting lever 11 is moved upwards in that it is drawn upwards partly out of the mount 13 due to the rail system formed with the mount 13. The upwards movement of the adjusting lever 11 results in a corresponding upwards movement of the functional part 3 which is pivoting in the course of this.

Figure 4:
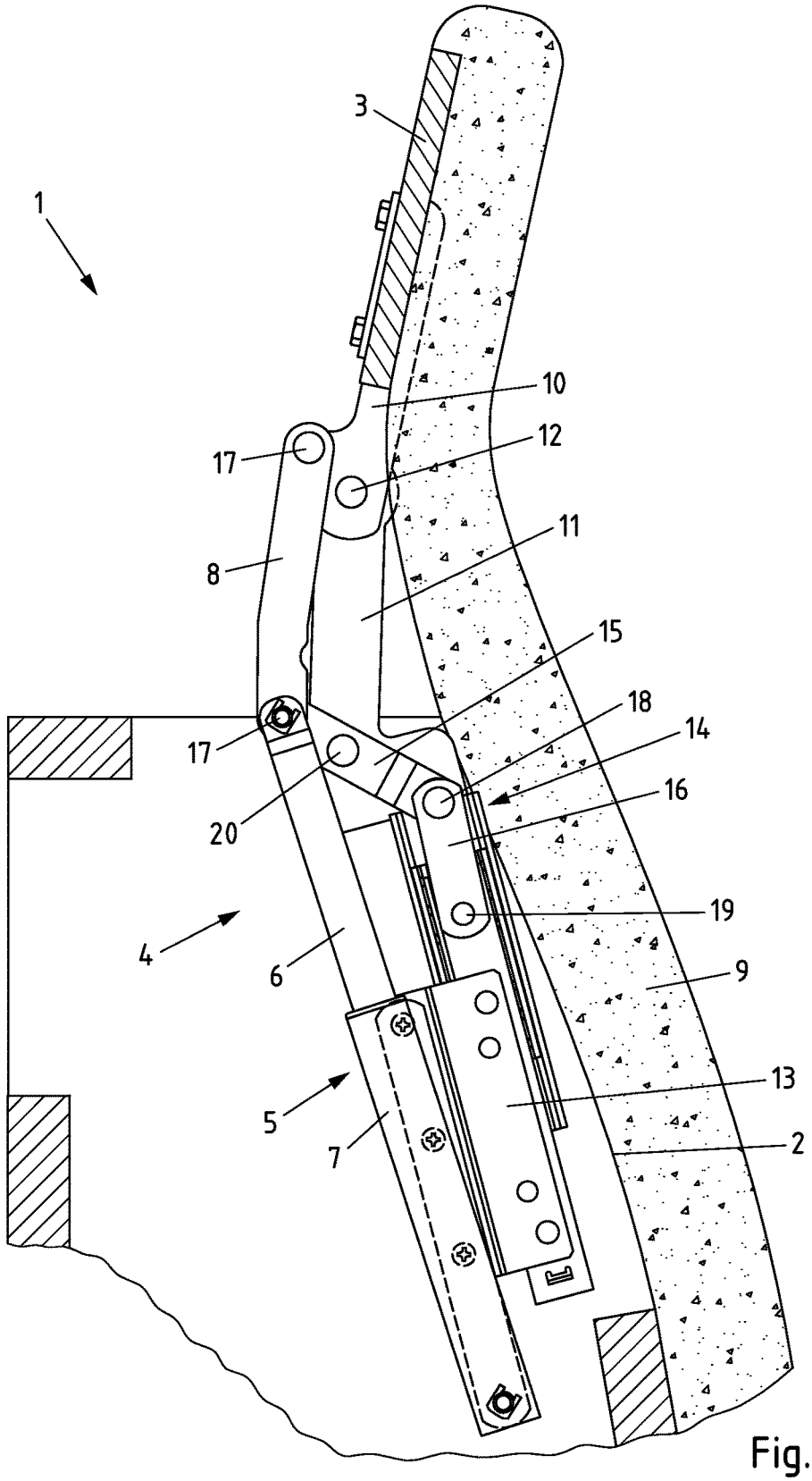
FIG. 4 is a side view of the seating furniture from FIG. 3 with a swiveled-up functional part.

The pivot fitting 4 can be brought out of its upper end position which is shown in FIGS. 2 and 4 into the lower end position again, shown in FIGS. 1 and 3. For this purpose, the steering lever 8 is moved downwards. The steering lever 8 ensures a pivoting movement of the functional part 3 into the rearward position via the coupling with the pivot lever 10. The steering lever 8 also pivots the control lever 15 downwards, the control lever 15 thereby moving the adjusting lever 11 downwards. The lower portion of the adjusting lever 11 is increasingly accommodated in the mount 13 on the base body 2. The control lever 15 thus moves the functional part 3 downwards.

The functional part 3 can only be moved back into the other end position or starting position according to FIGS. 1 and 3 out of the end position shown in FIGS. 2 and 4. However, the functional part 3 cannot be pivoted back from an intermediate position, or it can only be pivoted back slightly in any case in the corresponding direction, because this movement is then blocked by the lift setting mechanism 5. In this case, a clamping action is generated between the lug 6 and the guide means 7 of the lift setting mechanism 5. The corresponding clamping forces ensure that the lug 6 cannot be moved further into the guide means 7. Consequently, the pivot fitting 4 also cannot be pivoted further into the starting position according to FIGS. 1 and 3. Thus the functional part 3 is locked in the corresponding position, even if the user loads said functional part 3. Thus the functional part 3 is prevented from accidentally pivoting back. The situation is different only if the functional part 3 initially moves into the swiveled-up end position and as a consequence thereof, the lug 6 of the lift setting mechanism 5 is substantially fully extended with respect to the guide means 7.

If the functional part 3 is configured as a foot part or as an armrest, unlike the case in the illustrated item of seating furniture 1, the pivot fitting 4 and lift setting mechanism 5 are preferably configured analogously with respect to the functional part 3 and to the base body 2 which can then be provided by a seat, a frame or part of a frame, such as a side part. However, the arrangement and orientation of pivot fitting 4 and lift setting mechanism 5 in the seating furniture 1 can then differ and can be adapted to the connection of the functional part 3 to the base body 2 and to the operation and desired adjustment of the functional part 3.

The mode of operation of the lift setting mechanism 5 and thereby its effect with regard to the pivot of the pivot fitting 4 of the illustrated and in this respect preferred seating furniture 1 will be described in more detail with reference to FIGS. 5 to 12.

Figure 5:
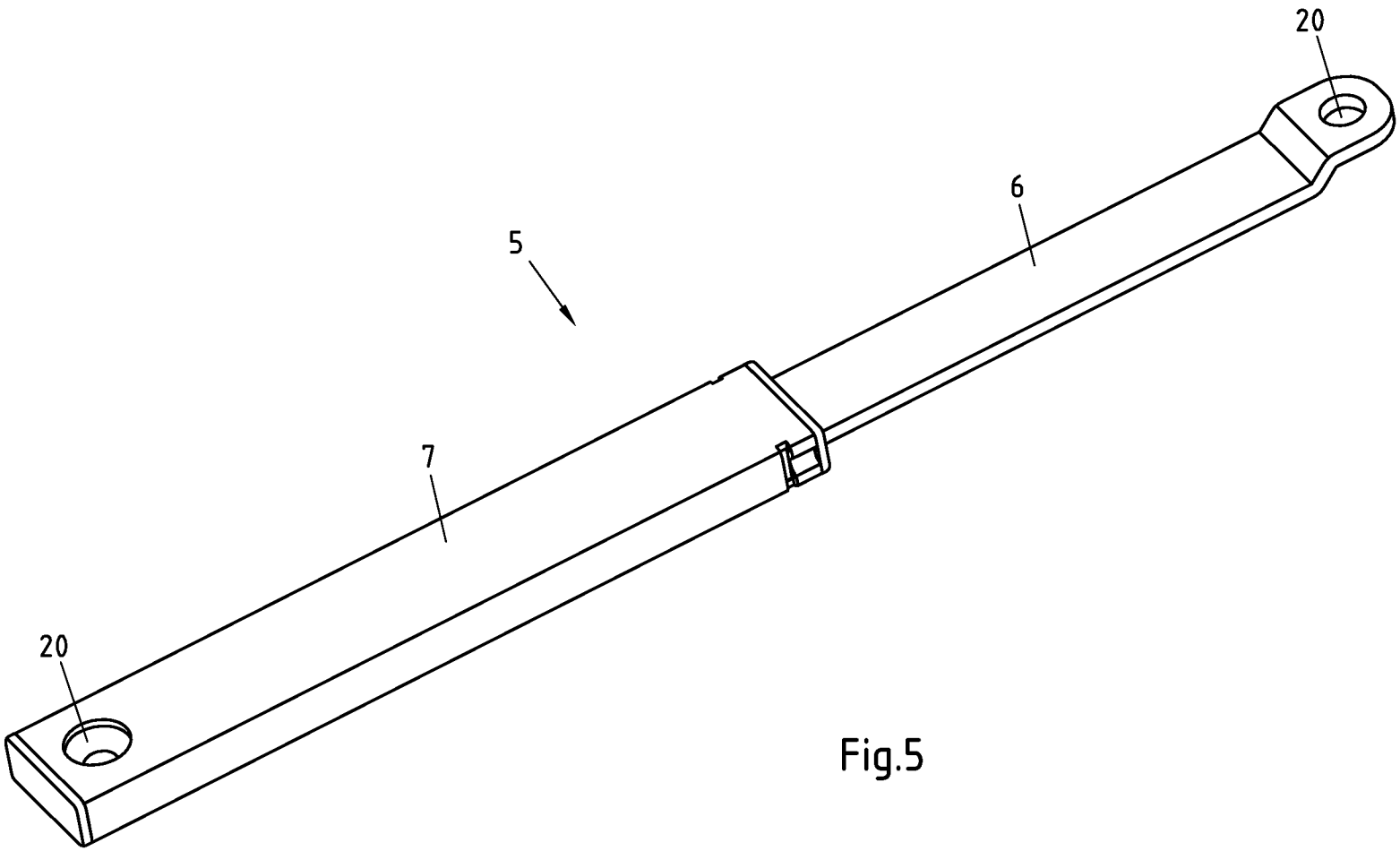
FIG. 5 is a perspective view of a lift setting mechanism.

FIG. 5 is a perspective view of the lift setting mechanism 5. The lift setting mechanism 5 comprises a respective continuous opening 20 at the rear end of the guide means 7, configured as a housing, and at the front end of the lug 6. The lift setting mechanism 5 is mounted pivotably on the pivot fitting 4 by the openings 20. In the illustrated and in this respect preferred seating furniture 1, the lug 6 is substantially strip-shaped, but it could also be rod-shaped, for example. The guide means 7 of the lift setting mechanism 5 also preferably has a corresponding, rectangular cross section. Furthermore, the guide means 7 is configured as a substantially closed housing to protect against soiling.

Figure 6A:
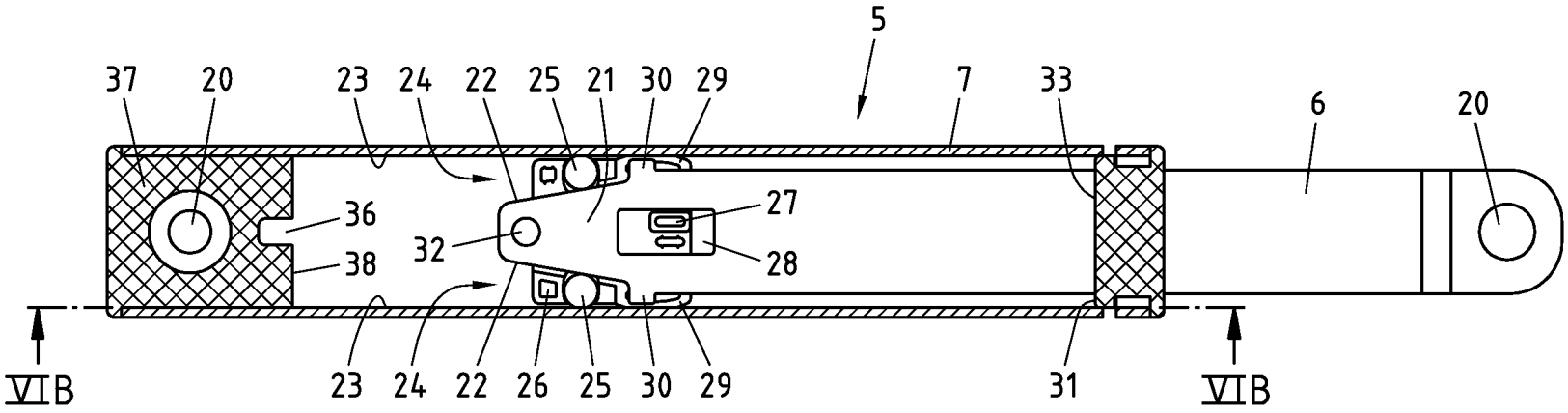
FIG. 6A-B are sectional views along lines VIA-VIA and VIB-VIB of the lift setting mechanism from FIG. 5 in a partly extended position.
Figure 6B:
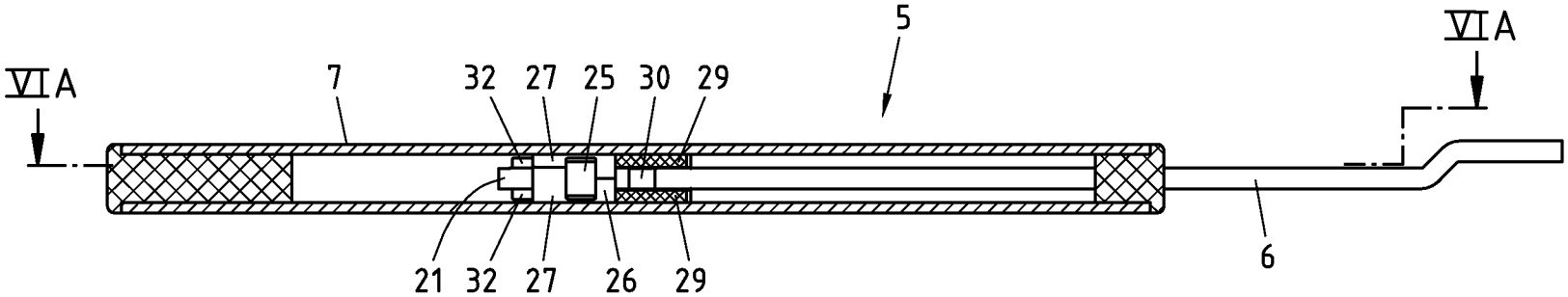

In FIGS. 6A and 6B, the lift setting mechanism 5 is shown in two sectional views, positioned vertically to one another in a partly extended position. The lug 6 has a tapering inner end 21. This end 21 forms, corresponding to the two narrow sides of the lug 6, two outer surfaces 22 which extend obliquely to the opposite inner sides 23 of the guide means 7 which, in the illustrated and in this respect preferred lift setting mechanism 5, are oriented parallel to one another and parallel to the extension direction of the lug 6. Correspondingly formed between the obliquely extending surfaces 22 of the lug 6 and the opposite inner sides 23 of the guide means 7 are clamping gaps 24 which accommodate clamping elements 25. In the illustrated and in this respect preferred lift setting mechanism 5, the surfaces 22 forming the clamping gaps 24 are flat and the clamping elements 25 have a cylindrical shape.

If the lug 6 is pressed into the guide means 7 from the position shown in FIG. 6A, the lift setting mechanism 5 is blocked because the clamping elements 25 on both sides of the lug 6 become wedged in the clamping gaps 24 provided there. In this respect, the clamping elements 25 can absorb high clamping forces so that the lug 6 is securely fixed with respect to the guide means 7.

In the illustrated and in this respect preferred lift setting mechanism 5, the clamping elements 25 are held in a clamping slide 26 which for its part is held on the lug 6. The clamping slide 26 is formed in two parts and engages around the lower end of the lug 6. In this respect, fingers 27 of the clamping slide engage in a slot 28 or enlarged hole in the lug 6 in order to mount the clamping slide 26 such that it is slightly displaceable with respect to the lug 6. The clamping slide 26 also has on two mutually opposite sides friction tabs 29 which rest on the inner sides 23 of the guide means which cooperate with the clamping elements 25. The static friction generated thereby ensures that the clamping slide 26 tends to retain its position if the clamping slide 26 is freely displaceable with respect to the lug 6.

In the extension direction, lateral noses 30 of the lug 6 and the guide means 7 form corresponding stop surfaces which together form an end stop 31 for the lug 6 and prevent the lug 6 from being further extended out of the guide means 7. The pivot fitting 4, connected to the lift setting mechanism 5 is thereby also prevented from being moved further.

Figure 7:
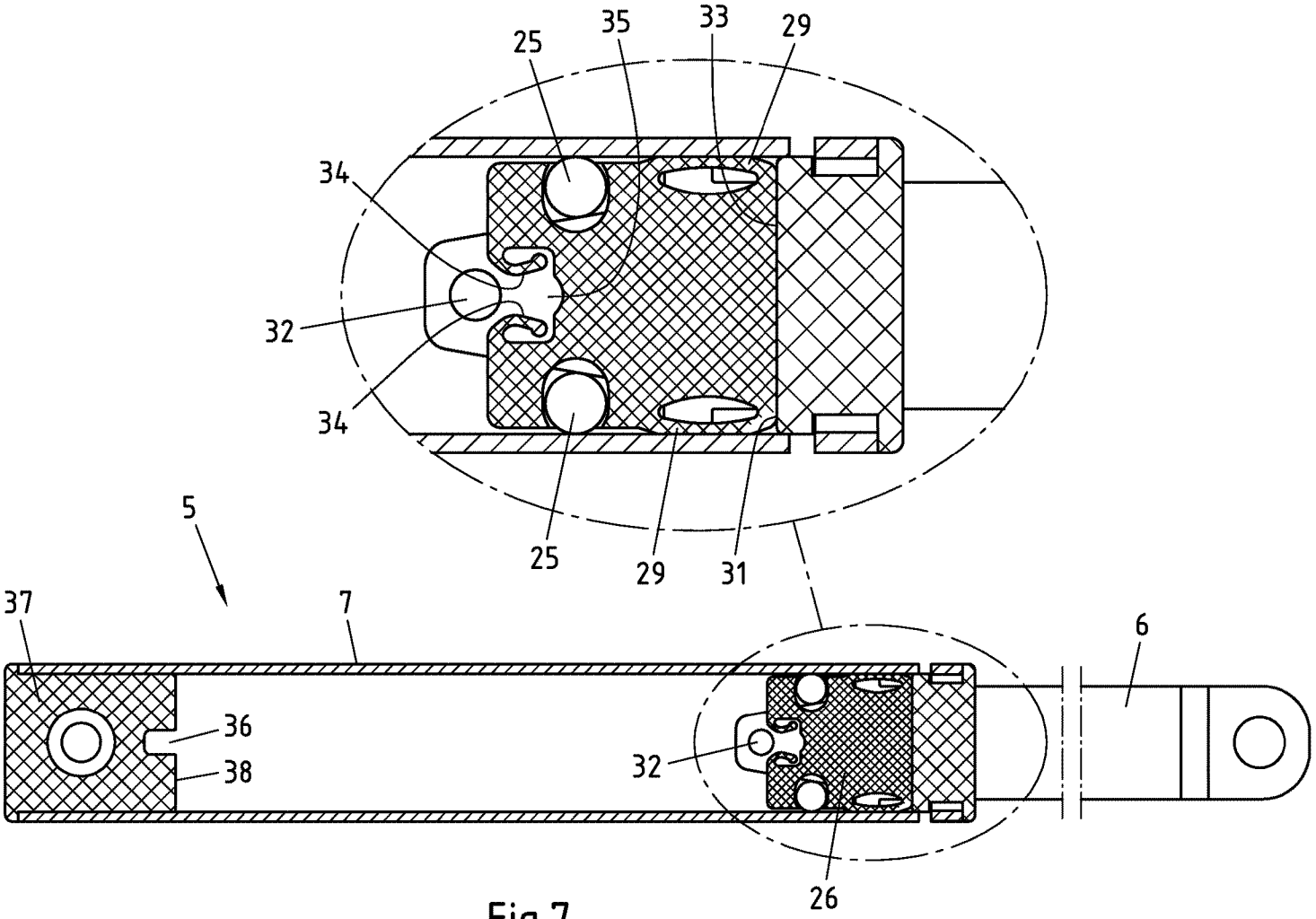
FIG. 7 is a longitudinal sectional view of the lift setting mechanism from FIG. 5 in an almost fully extended position.

If the lug 6 is extended further out of the guide means 7 from the position shown in FIG. 6A, the lift setting mechanism 5 arrives in the position shown in FIG. 7 in which the lug 6 has almost been extended out of the guide means 7 to an end position. Consequently, the clamping slide 26 which rests on the pin 32 of the lug 6 has been moved as far as an end stop 33 for the clamping slide 26. This end stop 33 restricts the further displacement of the clamping slide 26 in the extension direction of the lug 6.

Figure 8:
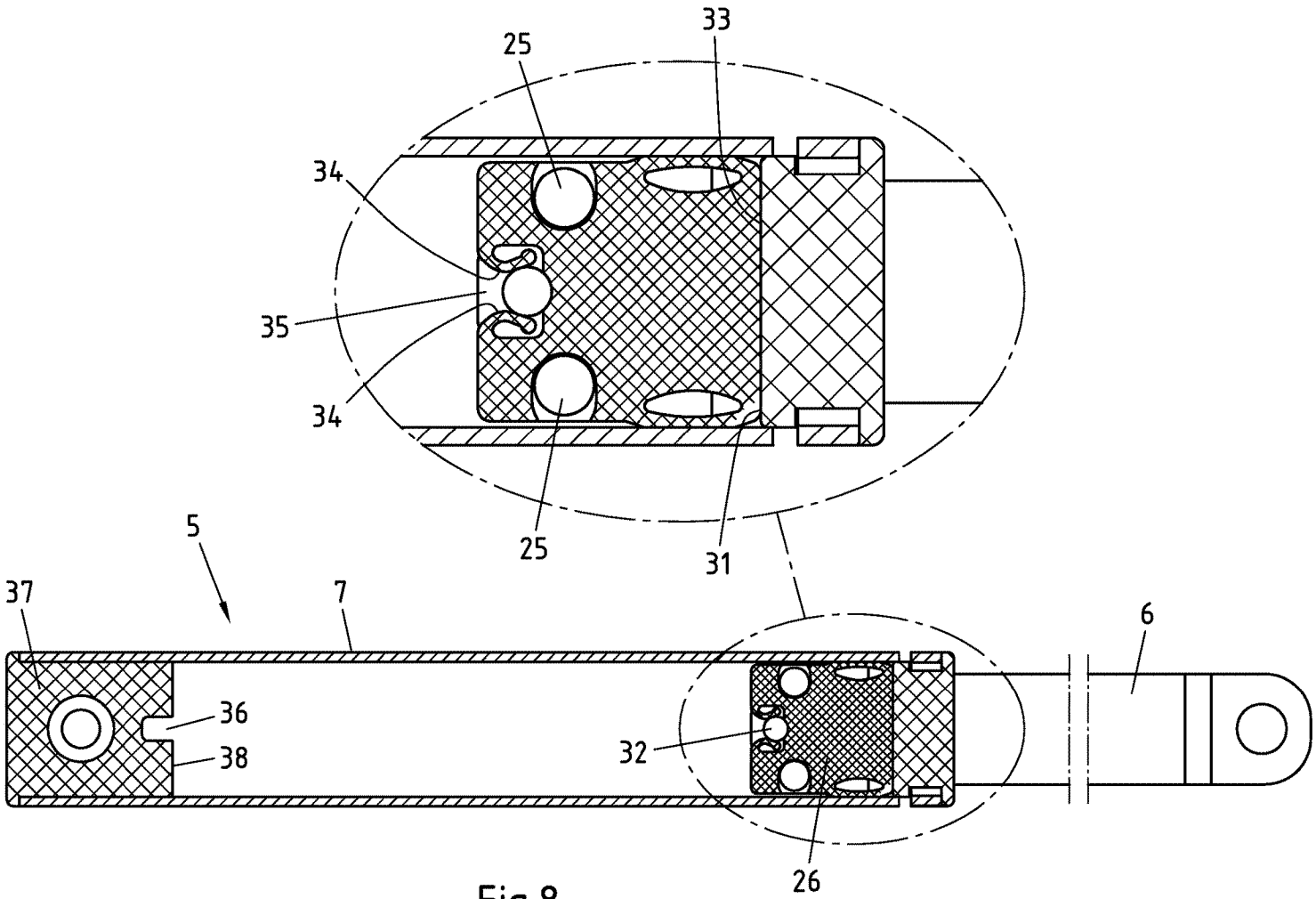
FIG. 8 is a longitudinal sectional view of the lift setting mechanism from FIG. 5 in an extended end position.

When the lug 6 is then extended further out of the guide means 7 into the position shown in FIG. 8, the pins 32 of the lug 6 slide past the tab-shaped connection elements 34 of the clamping slide 26, after which the connection elements 34 engage behind the pins 32 and thus form a separate connection between the lug 6 and the clamping slide 26. In this respect, the pins 32 are accommodated in corresponding seats 35 in the clamping slide 26. This is shown in particular in FIG. 4. The clamping slide 26 is now connected to the lug 6 in a position in which the clamping elements 25 cannot pass in a clamping manner into the clamping gaps 24. Therefore, the lug 6 can be inserted into the guide means 7 without expending a great amount of force.

To release the separate connection between the clamping slide 26 and the lug 6 again, the lug 6 has to be moved into a starting position with respect to the guide means 7. The pins 32 of the lug 6 then engage in a free space 36 in the base 37 of the guide means 7. Before the lug 6 reaches this starting position, the clamping slide 26 comes into contact with the base 37 of the guide means 7. In this way, the base 37 forms an initial stop 38 for the clamping slide 26. The clamping slide 26 is held in this position while the lug 6 can be moved further into the guide means 7. In this respect, the pins 32 of the lug 6 are pressed past the connection elements 34 of the clamping slide 26 and the positive locking connection between the lug 6 and the clamping slide 26 is released. The pins 32 of the lug 6 are then no longer accommodated in the corresponding seats 35 in the clamping slide 26. The lug 6 can thus be partly extended again and, in so doing, it can entrain the clamping slide 26 in order to again counteract a renewed insertion of the lug 6 in the corresponding position. In order to be able to move the lug 6 into the guide means 7 in the starting position again, the lug 6 must firstly be extended again as far as the end position, as described, in order to thus fix the clamping slide 26 on the lug 6 by the separate locking connection.

Figure 9:
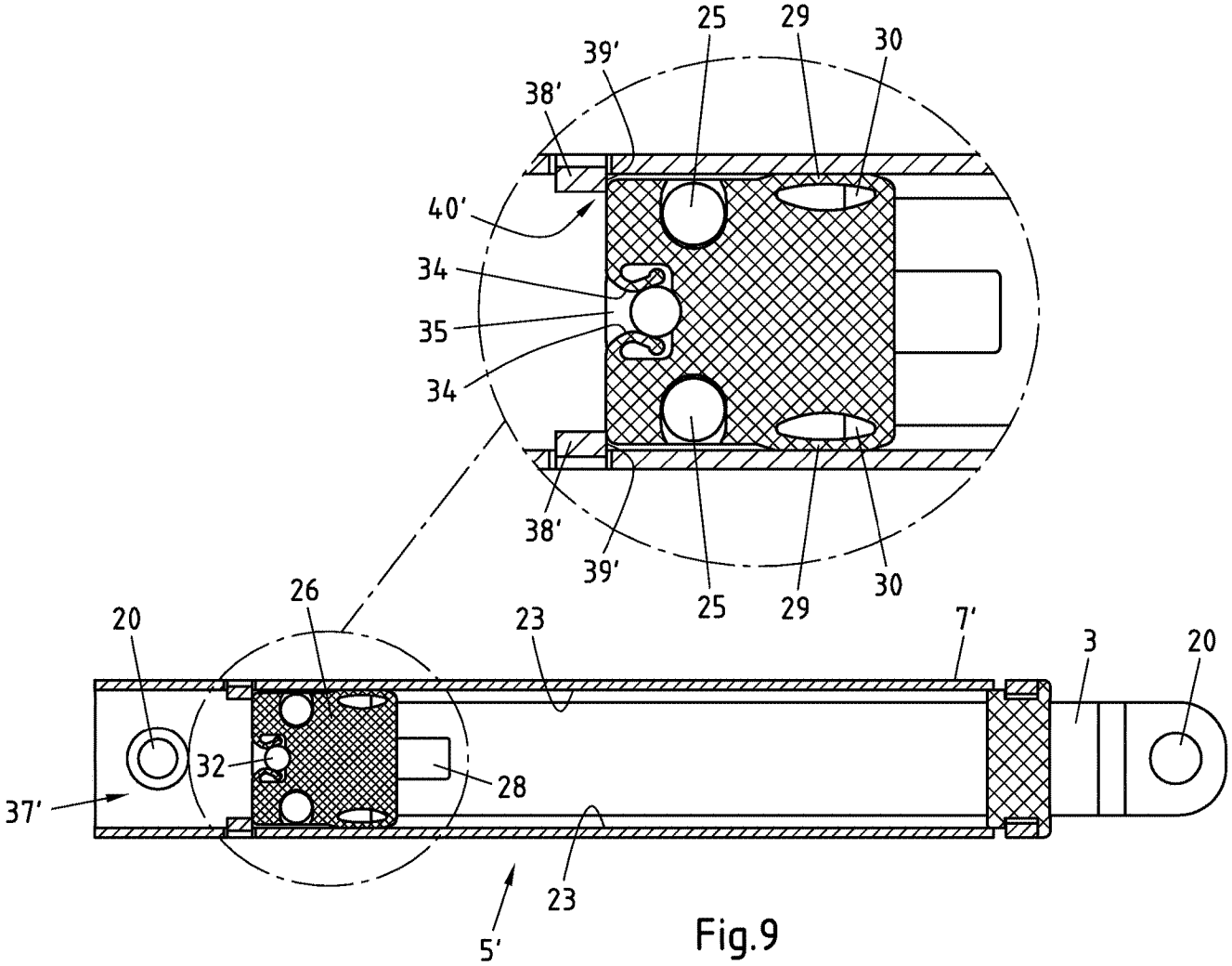
FIG. 9 is a longitudinal sectional view of the lift setting mechanism from FIG. 9 in an almost fully retracted position.
Figure 10:
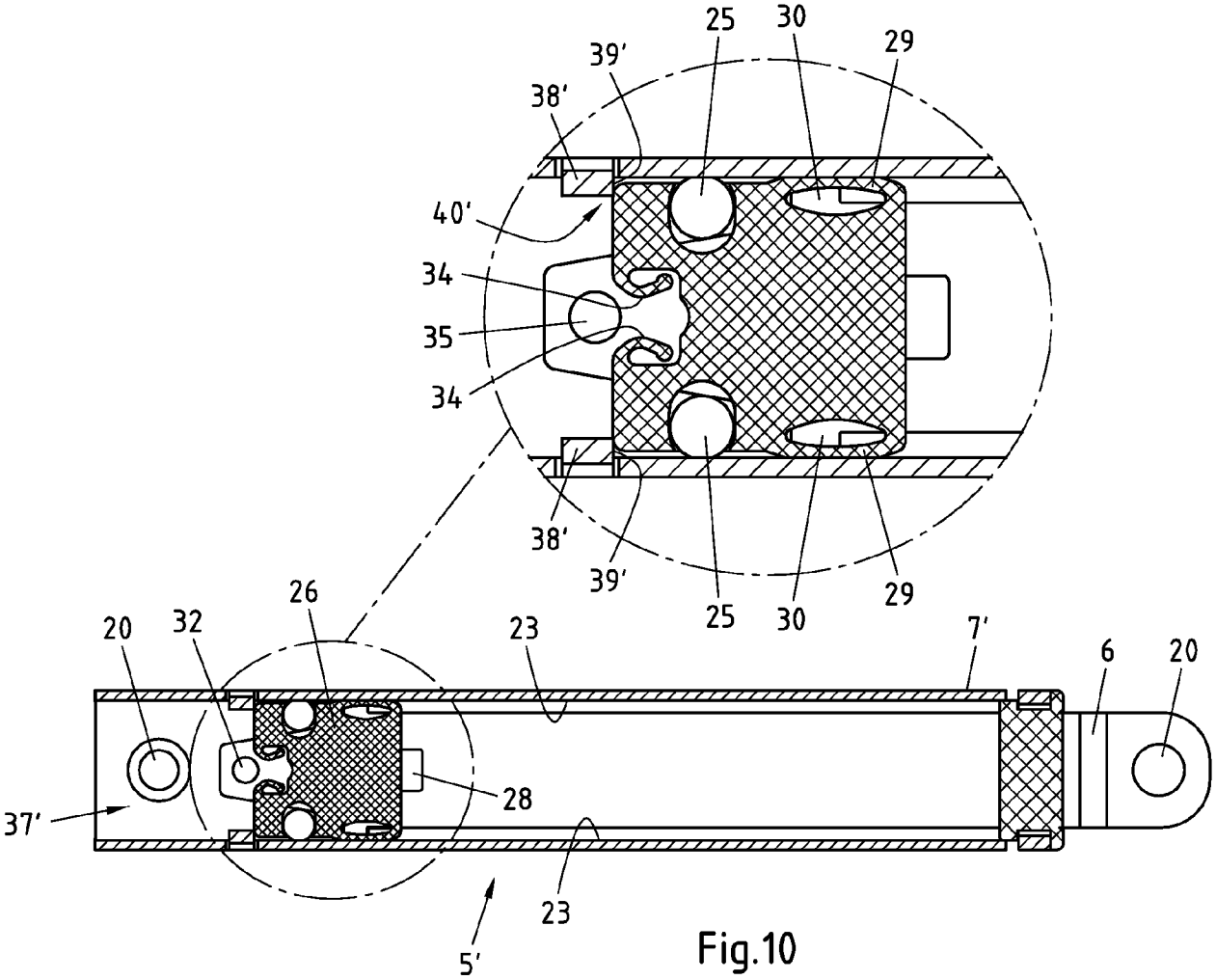
FIG. 10 is a longitudinal sectional view of the lift setting mechanism from FIG. 9 in a retracted starting position.

FIGS. 9 and 10 show an alternative lift setting mechanism 5'. This lift setting mechanism differs from the lift setting mechanism 5 of FIGS. 5 to 8 only by the configuration of the base 37' and it is also shown in a longitudinal sectional view.

The base 37' of the lift setting mechanism 5' has two edge elements 38' of the guide means 7' which are pressed inwards and provide the stop surfaces 39' oriented in the extension direction. The stop surfaces 39' form an initial stop 40' for the clamping slide 26. Instead of inwardly pressed edge elements 38' of the guide means 7', the stop surfaces 39' could also be provided by another stop element.

When the lug 6, connected to the clamping slide 26 by the separate connection which has already been described, is inserted in the direction of its starting position with respect to the guide means 7', the clamping slide 26 firstly arrives at an initial stop 40' defined by the stop surfaces 39'. The clamping slide 26 is held in this position, while the lug 6 can be inserted further with respect to the guide means 7'. Due to the corresponding relative movement between the lug 6 and the clamping slide 26, the pins 32 of the lug 6 are pressed past the connection elements 34 of the clamping slide 26 out of the seat 35 thereof and in so doing, the separate connection between the clamping slide 26 and the lug 6 is released. Nevertheless, the clamping slide 26 is still held on the lug 6 in a further displaceable manner with respect to the lug 6 so that on the one hand, the lug 6 can be extended again and on the other hand the clamping elements 25 continuously prevent the lug 6 from being accidentally pushed back with respect to the guide means 7', as has basically already been described. The releasable connection between the lug 6 and the clamping slide 26 is also connected during the extension of the lug 6 with respect to the guide means 7' as previously described.

In the illustrated and in this respect preferred item of seating furniture 1, in which the functional part 3 is configured as a head part and the base body 2 is configured as a backrest, the pivot fitting 4 and the lift setting mechanism 5 are oriented substantially vertically. However, it is also possible for the pivot fitting and the lift setting mechanism to be oriented horizontally, more specifically in particular when the functional part is in the form of a foot part and the base body is in the form of a seat. For example the functional part can then be pivoted out of a lower more vertical position into an upper more horizontal position and back.

Figure 11:
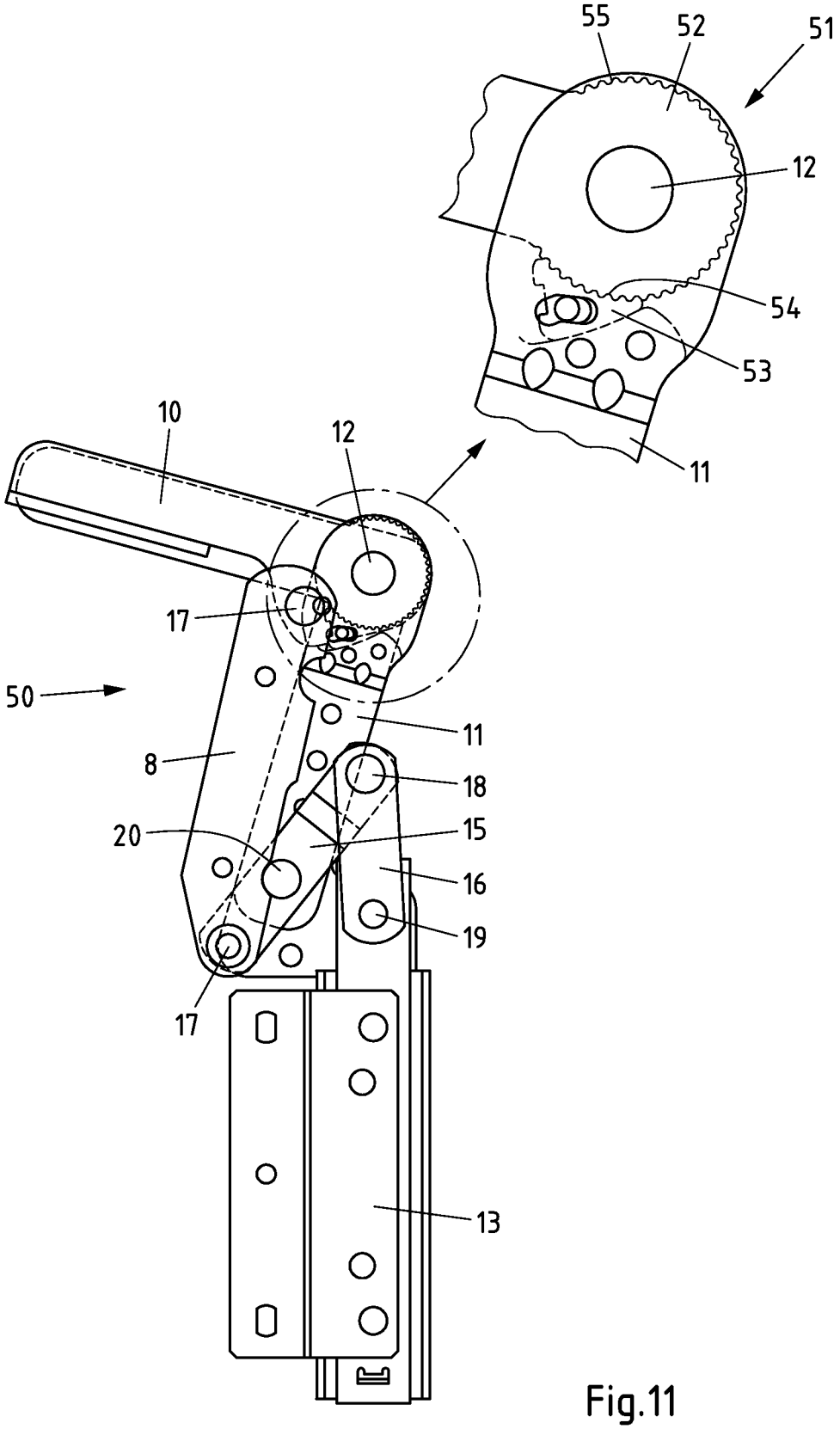
FIG. 11 is a side view of a pivot fitting with a locking joint and a swiveled-back pivot lever.
Figure 12:
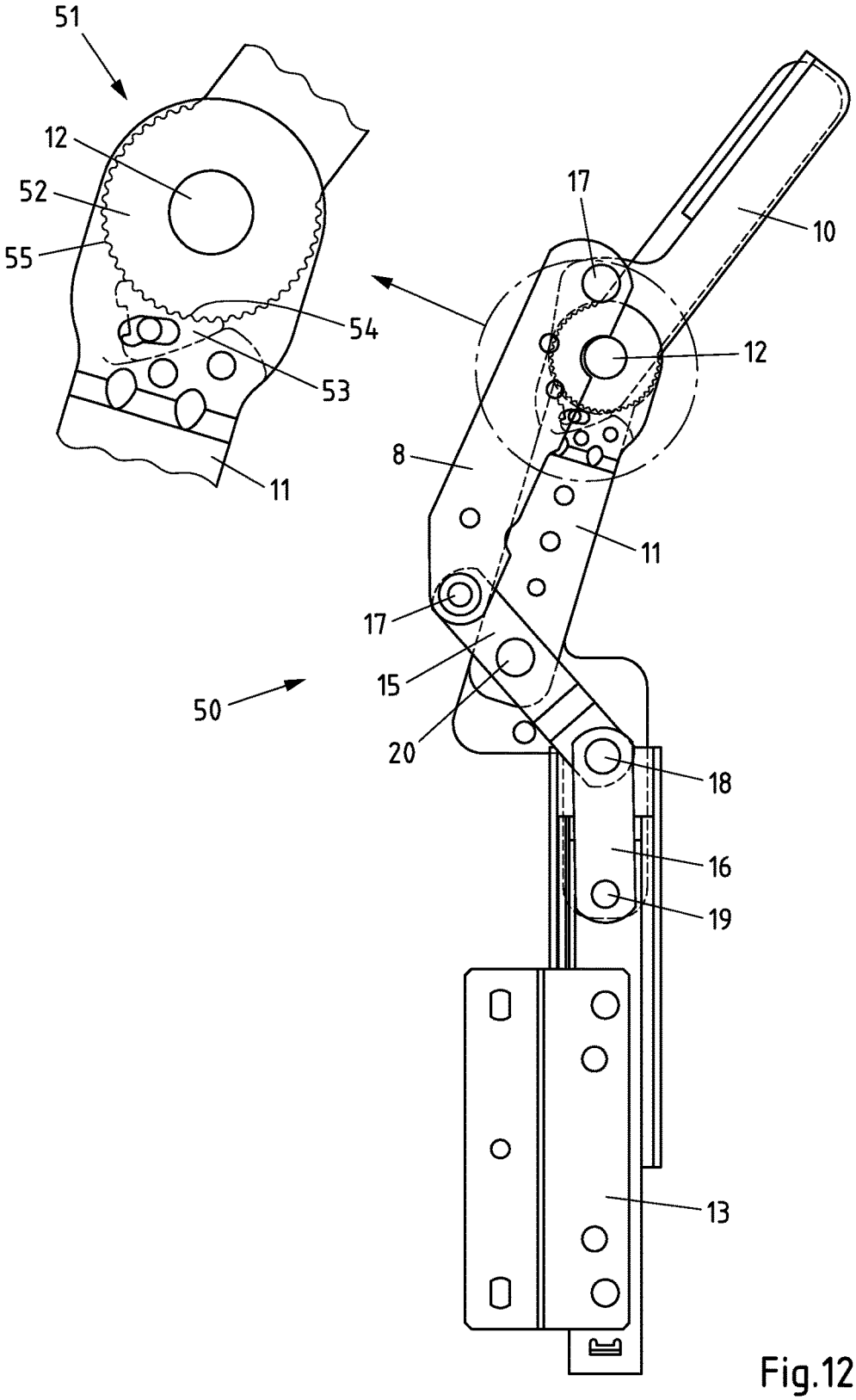
FIG. 12 is a side view of the pivot fitting from FIG. 11 with a swiveled-up pivot lever.

FIGS. 11 and 12 show a pivot fitting 50 without seating furniture. Instead of a lift setting mechanism, the pivot fitting 50 has a locking joint 51 which interconnects the pivot lever 10 and the adjusting lever 11. In this respect, the same components have been provided with the same reference numerals. The locking joint 51 has a toothed ring 52 which is connected for co-rotation with the pivot lever 10. Fixed on the adjusting lever 11 is a locking mechanism 53 which has teeth 54 corresponding to the toothed ring 52. The locking mechanism 53 is pretensioned by a spring and therefore engages by its teeth 54 into the teeth 55 of the toothed ring 52. The flanks of the teeth of the tooth systems 54, 55 are configured such that the toothed ring 52 can slide on the locking mechanism 53 when the pivot lever 10 is swiveled in the direction of the swiveled-up position. The teeth 55 of the toothed ring 52 then press the locking mechanism 53 outwards so that the toothed ring 52 is rotated tooth by tooth with respect to the locking mechanism 53 and the locking mechanism 53 engages continually in the toothed ring 52. For this purpose, the flanks which slide on one another are inclined towards the periphery of the toothed ring 52. If the pivot lever 10 is pressed in the opposite direction, flanks of the corresponding tooth systems 54, 55 which are oriented more steeply with respect to the periphery of the toothed ring 52 come to rest against one another. Therefore, the locking mechanism 53 locks the toothed ring 52 so that the toothed ring cannot rotate further in the corresponding direction. The pivot lever 52 and the functional part connected to the pivot lever 10 are also fixed thereby. The user of the seating furniture can thus rest parts of his body against the functional part, without the functional part giving way and pivoting back.

So that the pivot lever 10 can nevertheless be reset again, the illustrated and in this respect preferred pivot fitting 50 has to be pivoted into an end position, more specifically into the fully swiveled-up position of the functional part. By means (not shown), the locking mechanism 53 is then forcibly separated from the toothed ring 52 so that the toothed ring 52 can be freely rotated with respect to the locking mechanism 53, more specifically into the other end position or starting position. There, the separation of locking mechanism 53 and toothed ring 52 is reversed again and the pivot lever 10 can again pivot gradually into the swiveled-up position. The locking mechanism 53 and toothed ring 52 can be separated in that the locking mechanism 53 is pushed outwards against the spring force and is held there. This fixing is then reversed by force, for example by a stop when the starting position has been reached.

The pivot fitting 50 according to FIGS. 11 and 12 otherwise operates in the same manner as described in connection with FIGS. 1 to 4, i.e. apart from the locking or fixing of the pivot lever 10 in different positions. It is also pointed out that a locking/clamping joint could also be provided. In a joint of this type, the locking mechanism and the toothed ring do not have to be separated from one another in order to reset the pivot lever into the starting position. A clamping action between the pivot lever and the adjusting lever merely has to be overcome so that the joint allows a rotation in the direction of the starting position. Nevertheless, means can be provided to produce a forced separation of locking mechanism and toothed ring and to reverse this separation again when the corresponding end positions of the pivot lever have been reached. This is not necessary anyway due to the clamping action. It is particularly effective if clamped between the pivot lever and the adjusting lever is at least one friction disc which has at least one friction surface on which an adjoining component slides while the pivot lever is pivoted in the direction of the starting position.

The invention claimed is:

1. A piece of seating furniture comprising:

a base body comprising:

a lift setting mechanism comprising a guide and a lug displacably extending from the guide;

a steering lever pivotably connected to the lug and to a control lever; and an adjusting lever, pivotably connected to the control lever;

the piece of seating furniture further comprising:

a functional part supported by a pivot lever, pivotably connected to the adjusting lever such that the functional part can be pivoted with respect to the base body, wherein the lift setting mechanism is configured to lock the functional part with respect to the base body, wherein the lift setting mechanism can be moved out of an adjustment position which blocks the movement of the functional part relative to the base body into several positions in a direction of load into a reset position which releases the movement of the functional part relative to the base body from at least one position in the direction of load, wherein the adjusting lever can be moved with respect to the base body out of a lower, retracted position into an upper, extended position and back, and wherein the control lever is connected to the adjusting lever such that when the adjusting lever is moved from the lower, retracted position into the upper, extended position, the control lever is pivoted with respect to the base body and/or to the adjusting lever and thus causes a pivoting movement of the pivot lever with respect to the adjusting lever via the steering lever.

2. The piece of seating furniture according to claim 1, wherein the lift setting mechanism comprises at least one clamping element provided in the guide, the at least one clamping element being displaceable with respect to the lug between a clamping position and at least one adjustment position, and wherein, in the clamping position, the at least one clamping element is received in a clamping gap between the lug and the guide such that the lug is prevented from moving with respect to the guide in one direction.

3. The piece of seating furniture according to claim 2, wherein the clamping gap tapers in one direction and/or wherein the clamping element is clamped between a tapering end of the lug and the guide in the clamping position.

4. The piece of seating furniture according to claim 2, wherein the at least one clamping element is provided on a clamping slide, wherein the clamping slide is held in a slot in the lug such that the clamping slide is displaceable with respect to the lug.

5. The piece of seating furniture according to claim 2, wherein at least one of the clamping element and the clamping slide is releasably connected to the lug such that the releasable connection is locked when the lug is moved with respect to the guide into a connection position or when at least one of the clamping element and the clamping slide impacts against an end stop.

6. The piece of seating furniture according to claim 2, wherein at least one of the clamping element and the clamping slide is releasably connected to the lug such that the releasable connection is unlocked when the lug is moved with respect to the guide into a release position or when at least one of the clamping element and the clamping slide impacts against an initial stop.

7. The piece of seating furniture according to claim 2, wherein at least one clamping element and/or the clamping slide is frictionally engaged with an interior portion of the guide.

8. The piece of seating furniture according to claim 1, wherein the lug can be moved continuously along the guide.

9. A piece of seating furniture comprising a base body, and a functional part which can be pivoted with respect to the base body, at least one pivot fitting for adjusting the functional part relative to the base body and a locking joint for locking the functional part with respect to the base body in a locking position of the locking joint, wherein the functional part is supported by a pivot lever and is connected to the base body by an adjusting lever, wherein the pivot lever and the adjusting lever are interconnected by the locking joint forming a pivot axis and wherein the locking joint has a toothed ring and a locking mechanism which engages in the toothed ring in the locking position, wherein the adjusting lever can be moved with respect to the base body out of a lower position into an upper position and back, wherein the pivot lever is connected to the base body by a lever connection comprising a steering lever and a control lever, wherein the control lever is pivotably connected to the steering lever and the adjusting lever, and wherein the control lever is connected to the adjusting lever such that when the adjusting lever is moved from the lower position into the upper position and back, the control lever is pivoted with respect to the base body and/or to the adjusting lever and thus causes a pivoting movement of the pivot lever with respect to the adjusting lever via the steering lever.

10. The piece of seating furniture according to claim 9, wherein the locking mechanism is spring-loaded in the direction of the toothed ring.

11. The piece of seating furniture according to claim 9, wherein the toothed ring and the locking mechanism can be disengaged in a pivot position for pivoting the pivot lever with respect to the adjusting lever in a starting position.

12. The piece of seating furniture according to claim 9, wherein the pivot lever and the adjusting lever are held non-positively and in that the toothed ring is held to the locking joint such that the toothed ring is rotatable with respect to the pivot lever and/or to the adjusting lever such that in the locking position, the pivot lever can be pivoted with respect to the adjusting lever in one direction.

13. The piece of seating furniture according to claim 9, wherein a clamp is provided for adjusting the frictional connection between the pivot lever and the adjusting lever.

14. The piece of seating furniture according to claim 1, wherein the control lever is connected by one end to the base body by another end to the steering lever and is connected between both ends to the adjusting lever.

15. The piece of seating furniture according to claim 1, wherein the lever connection engages on the pivot lever by a pivot connection, the pivot axis, is arranged between the end of the pivot lever associated with the free end of the functional part and the pivot connection, between the pivot lever and the adjusting lever.

16. The piece of seating furniture according to claim 1, wherein the adjusting lever is held on the base body by a mount and can be telescoped, at least partly in a vertical direction with respect to the mount.

17. The piece of seating furniture according to claim 1, wherein the control lever is connected directly or by a compensating lever on the mount.

* * * * *